US007371294B2

(12) United States Patent
Miura et al.

(10) Patent No.: US 7,371,294 B2
(45) Date of Patent: May 13, 2008

(54) HIGH-STRENGTH COLD-ROLLED STEEL SHEET HAVING OUTSTANDING ELONGATION AND SUPERIOR STRETCH FLANGE FORMABILITY AND METHOD FOR PRODUCTION THEROF

(75) Inventors: Masaaki Miura, Kakogawa (JP); Yoichi Mukai, Kakogawa (JP); Yoshinobu Omiya, Kakogawa (JP); Shinji Kozuma, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 496 days.

(21) Appl. No.: 11/045,309

(22) Filed: Jan. 31, 2005

(65) Prior Publication Data

US 2005/0167007 A1 Aug. 4, 2005

(30) Foreign Application Priority Data

Feb. 2, 2004 (JP) ..... 2004-025777

(51) Int. Cl.
*C22C 38/22* (2006.01)
*C22C 38/12* (2006.01)

(52) U.S. Cl. ..... 148/333; 148/334; 148/320; 148/328

(58) Field of Classification Search ..... 148/333–334, 148/320, 328, 603, 650–652; 420/104–111, 420/123–124

See application file for complete search history.

(56) References Cited

FOREIGN PATENT DOCUMENTS

| | | | | |
|---|---|---|---|---|
| JP | 63-241115 | | 10/1988 | |
| JP | 63-293121 | | 11/1988 | |
| JP | 9-67645 | | 3/1997 | |
| JP | 362074024 A | * | 4/1997 | ..... 148/320 |
| JP | 10-237547 | | 9/1998 | |
| JP | 11-350038 | | 12/1999 | |

* cited by examiner

*Primary Examiner*—Deborah Yee
(74) *Attorney, Agent, or Firm*—Oblon, Spivak, McClelland, Maier & Neustadt, P.C.

(57) ABSTRACT

A high-strength cold-rolled steel sheet is disclosed that comprises a steel including C: 0.05 to 0.13 mass %, Si: 0.5 to 2.5 mass %, and Mn: 0.5 to 3.5 mass %, as well as Mo: 0.05 to 0.6 mass % and/or Cr: 0.05 to 1.0 mass %. The steel sheet is of composite structure of a ferrite+a second phase wherein the second phase has an area rate of 30 to 70% and is combined approximately in a shape of a network; a circle-equivalent average ferrite grain size is not more than 10 μm; and a circle-equivalent diameter of ferrite grain aggregate that exists continuously in an area surrounded by the second phase is not more than 3 times of the average ferrite grain size. The steel sheet has a high-strength and satisfies a balance of elongation and stretch flange formability (ratio of hole expansion) at a higher level.

6 Claims, 2 Drawing Sheets

HIGH-STRENGTH COLD-ROLLED STEEL SHEET HAVING OUTSTANDING ELONGATION AND SUPERIOR STRETCH FLANGE FORMABILITY AND METHOD FOR PRODUCTION THEROF

BACKGROUND OF THE INVENTION

The present invention relates to a high-strength cold-rolled steel sheet having a composite structure composed of a ferrite and a second phase (mainly martensite), excellent elongation and stretch flange formability, and superior workability, and also relates to a method for production thereof.

For example, steel sheets used for an automobile demands high-strength and excellent molding workability, taking into account both passenger's safety and body-weight reduction for saving fuel consumption. Various strengthening methods are adopted in manufacture of high-strength steel sheets. Especially as high-strength steel sheets strengthened using hard martensitic structure, much attention has been focused on a composite structure steel sheet having a ferrite-martensite two-phase structure.

The present inventors have investigated steel sheets with a composite structure having high-strength and superior workability. The present inventors has already proposed high-strength cold-rolled steel sheets having superior workability described in Japanese Patent Laid-Open (JP-A) Nos. 63-241115, 63-293121, 9-67645, 10-237547. All of these Referential Patents secure workability by a soft ferrite phase as a first phase (main phase) by specifying a content of C, Si, and Mn as basic components, and simultaneously, by using steel including proper quantity of Cr, Mo, etc., and by controlling cold rolling conditions and cooling conditions after hot-rolling, conditions of subsequent heat treatment and aging treatment, etc. They also realize coexistence of strength and workability by securing strength by precipitation of a low temperature transformation forming phase of martensite etc. having structure strengthening effect.

In recent years, it has become clear that adjustment of a hardness ratio and a hardness difference between a ferrite phase and a low temperature transformation forming phase in the steel sheet with a composite structure can improve stretch flange formability (λ) regarded as important for forming workability. In more detail, it has also become clear that a smaller hardness ratio and a smaller hardness difference can further improve stretch flange formability.

JP-A No. 11-350038 discloses a technique wherein a combination of suitable steel compositions and manufacturing conditions give suitable composite structure, and enables production of a cold-rolled steel sheet having superior elongation and stretch flange formability with concurrent secure of high-strength. The JP-A No. 11-350038 specifies a content of Nb, Ti or V as important additional trace elements, and it also clarifies that skillful use of refining effect of crystal grains by fine carbide, caused by addition of these elements, produced in steel gives both of excellent ductility and stretch flange formability.

The steel sheet with the composite structure is excellent in compatibility between a high-strength and excellent elongation and stretch flange formability. However, in recent years, there have been increased demands for thin-walled and light-weighted material steel sheets and yet improved processing efficiency. To cope with this, high-strength steel sheet having excellent elongation and stretch flange formability exceeding the conventional technique level would be needed.

SUMMARY OF THE INVENTION

Under the circumstances, the present invention aims to provide a high-strength cold-rolled steel sheet that can attain a higher level of balance of elongation and stretch flange formability (ratio of hole expansion:λ), while guaranteeing a strength of 780 MPa needed as a steel sheet for automobiles etc.

One aspect of the present invention resides in a high-strength cold-rolled steel sheet that has superior elongation and superior stretch flange formability. The high-strength cold-rolled steel sheet comprises a steel including C: 0.05 to 0.13 mass %, Si: 0.5 to 2.5 mass %, and Mn: 0.5 to 3.5 mass %, as well as Mo: 0.05 to 0.6 mass % and/or Cr: 0.05 to 1.0 mass %. The high-strength cold-rolled steel sheet is of composite structure of a ferrite+a second phase (exclusive of ferrite) wherein the second phase has an area rate of 30 to 70% and is combined approximately in a shape of a network; a circle-equivalent average ferrite grain size is not more than 10 μm; and a circle-equivalent diameter of ferrite grain aggregate that exists continuously in an area surrounded by the second phase is not more than 3 times of the average ferrite grain size.

A term of "approximately in a shape of a network" means that a case is included where the structure may not have a perfect network. A term of "circle-equivalent" in a circle-equivalent average ferrite grain size and a circle-equivalent diameter used herein mean a diameter of a circle having a same area.

In the aspect of the present invention, the high-strength cold-rolled steel sheet may also include at least one element selected from a group composed of Ti: 0.005 to 0.05 mass %, Nb: 0.005 to 0.05 mass %, and V: 0.005 to 0.2 mass %. These elements have a refining effect of crystal grains and contribute to further improvement in elongation and stretch flange formability. The second phase constituting the metallographic structure may be of martensite and of bainite. In order to aim at coexistence of elongation and stretch flange formability while securing high-strength, a more preferable second phase structure is of martensite or of tempered martensite.

In the aspect, in order to secure superior balance of elongation and stretch flange formability in a desired level of the present invention, a ratio (HvII/Hvα) between an average hardness of the second phase (HvII) and an average hardness (Hvα) of the ferrite phase is preferably not more than 3.0.

In the aspect, the high-strength cold-rolled steel sheet of the present invention is characterized by its superior balance of strength and workability, that is, a hardness level of not less than 780 MPa, not less than 14% of elongation (El), and not less than 50% of stretch flange formability (λ).

The aspect of the present invention permits a cold-rolled steel sheet having a high-strength and satisfying a balance of elongation and stretch flange formability (ratio of hole expansion) at a higher level as compared to conventional materials. Use of the cold-rolled steel sheet of the present invention especially for automotive structural material etc. can save the vehicle body weight, and thereby providing a very useful material focused on reduction of fuel consumption and low-pollution vehicles.

Other and further objects, features and advantages of the invention will appear more fully from the following description.

DETAILED DESCRIPTION OF THE PREFERRED EMBODIMENTS

Figure 1:
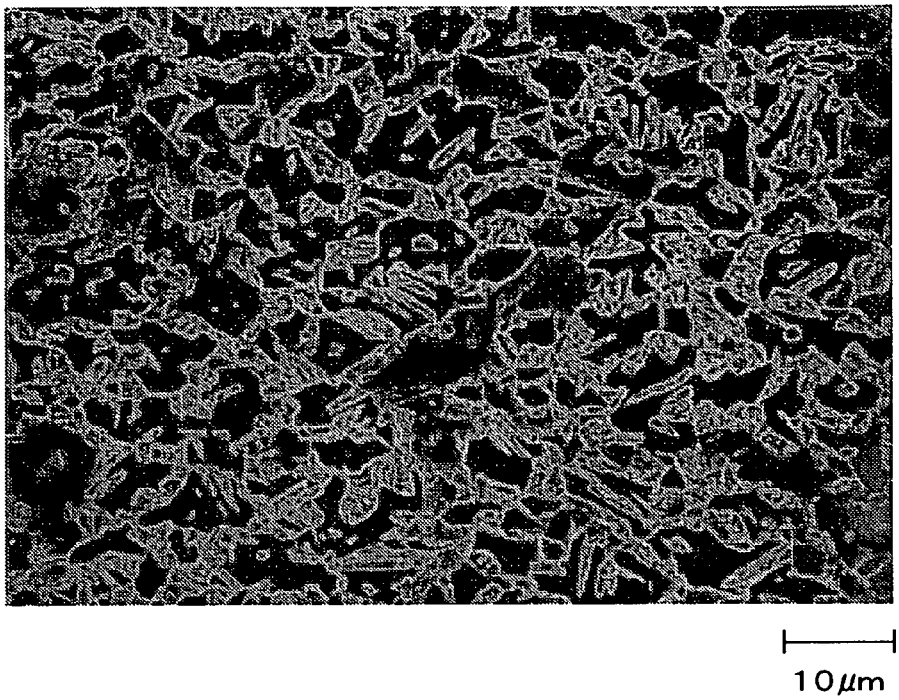
FIG. 1 shows an SEM photograph showing a microstructure of a steel sheet with a composite structure obtained in the Example.

A cold-rolled steel sheet of the present invention is characterized by a metallographic structure and a chemical component. Description about metallographic structure specified by the present invention will be given.

A metallographic structure of a cold-rolled steel sheet of the present invention under the observation of the optical microscope is a composite structure composed of a ferrite phase and a second phase. The second phase has an area rate of 30 to 70%, is combined approximately in a shape of a network, and is characterized by approximately uniform distribution of fine ferrite grains in a structure of a network-like second phase. In more detail, it is characterized in that a circle-equivalent average ferrite grain size in the composite structure is not more than 10 μm, and that a circle-equivalent diameter of a ferrite grain aggregate continuously existing in an area surrounded by the second phase combined approximately in a shape of a network is not more than 3 times of the average ferrite grain size.

The second phase is a hard low-temperature transformation product formed in annealing and cooling process after hot-rolling and cold-rolling of steel materials. Although the second phase may partially include bainite, it has tempered martensite or martensite as a principal component (preferably not less than 50% as area ratio, and more preferably not less than 80%), and existence of the hard second phase enables guarantee of high elongation and high-strength. Although less than 30 area % of an area ratio of the second phase gives superior elongation, it gives insufficient strength and insufficient stretch flange formability. An excessive amount of the second phase exceeding 70 area % causes shortage of the area ratio of soft ferrite phase, reduces an elongation percentage, and disables guarantee of a balance of elongation and stretch flange formability on a level desired in the present invention. In order to increase both of elongation and stretch flange formability while securing high-strength, preferable area ratios of the second phase are not less than 35% and not more than 60%.

Based on the premise of satisfying requirements for the area ratios of the second phase, an important feature in metallographic structure enabling differentiation between conventional steel sheets with a composite structure and cold-rolled steel sheet of the present invention is that the second phase is precipitated in a shape of fine, uniform and dense approximate network, and that fine ferrite grains are finely dispersed almost uniformly, as a small number of aggregate, in the second phase precipitated in the shape of the network. Specifically, as example shows in FIG. 1 (a micrograph in which a ferrite area ratio is 45%) in the after-mentioned Example, a cold-rolled steel sheet of the present invention is characterized in that a circle-equivalent average grain diameter of a ferrite constituting a composite metal structure is not more than 10 μm, and that a circle-equivalent diameter of a ferrite grain aggregate, continuously existing in an area (that is, each network) surrounded by the second phase (principally tempered martensite or martensite) precipitated approximately in a shape of a network, is not more than 3 times of an average ferrite grain size.

Figure 3:
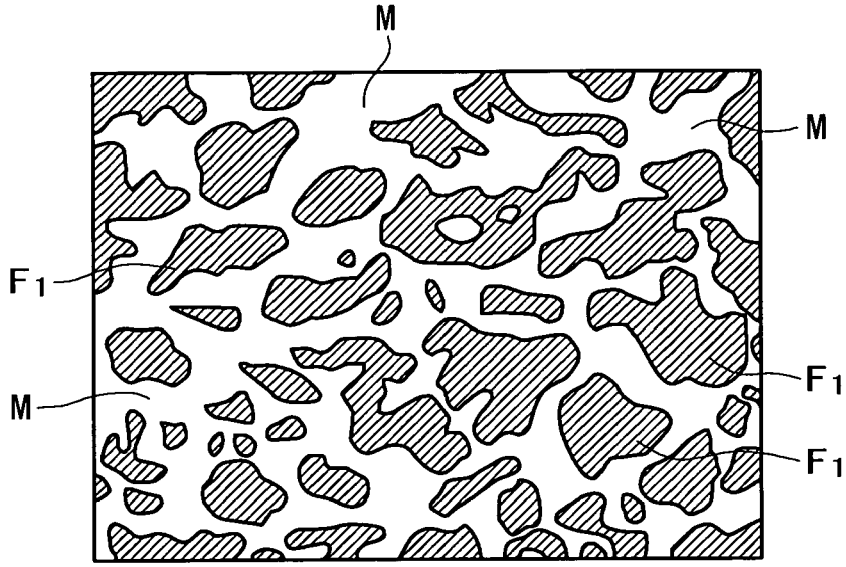
FIG. 3 is a schematical diagram conceptually showing an expanded microstructure photograph of a steel sheet with a composite structure obtained in the Example.

For example, FIG. 3 gives more concrete illustration of specificity of a metallographic structure of a steel sheet with a composite structure concerning the present invention, and an enlarged drawing showing schematically photograph substituted for drawing of FIG. 1 mentioned above. In FIG. 3, M shows a second phase precipitated in a shape of network, F1 and F1 show each ferrite grain, and each of ferrite grains F1 and F1 is fine (not more than 10 μm of circle-equivalent average grain diameter), and moreover a network of a second phase M itself precipitated approximately in a shape of a network is relatively thin, and the network is also fine. As a result, a number of ferrite grains F1 and F1 in a ferrite aggregate existing in the network is very small (In an illustrated example, the ferrite grains F1 and F1 divided by martensite formed in a shape of a network mostly form a single crystal grain. Besides, although two or more ferrite grains F1 may be combined by a very fine bridge in a cross-sectional structure photograph, grains combined by such a very thin bridge are regarded as being divided by the bridge part in the present invention.), and a circle-equivalent diameter of the ferrite aggregate continuously existing in an area surrounded by the second phase is controlled by at most not more than 3 times of the circle-equivalent average ferrite grain size.

Figure 2:
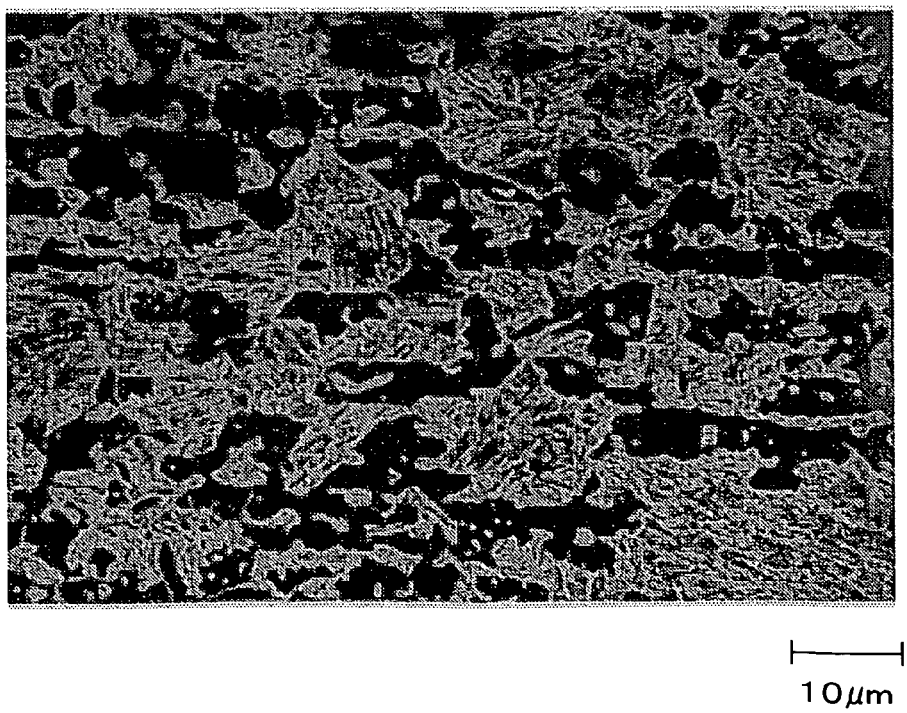
FIG. 2 shows an SEM photograph showing a microstructure of a steel sheet with a composite structure as a comparative material.

Incidentally, also in steel sheets with a composite structure mentioned as the conventional technology, observed is precipitation having an area ratio of a second phase of 40 area % and yet showing a shape of notionally coarse network. And examples having a metallographic structure of aggregate of ferrite grains currently dispersed in a coarse network may exist. For example, a photograph substituted for drawing of FIG. 2 illustrates the metallographic structure of the steel sheet with the composite structure produced with conventional methods. This example is a cold-rolled steel sheet having a ferrite area ratio in a whole structure of 30%, and an area ratio of a second phase (martensite) of 70%. As is clear from FIG. 2, in conventional materials, relatively coarser ferrite aggregates are distributed among relatively coarser aggregates of a second phase (martensite) as compared with the present invention. However, as compared with the FIG. 1 showing the metallographic structure of the steel sheet of the present invention, the network structure of the second phase is very coarse, and the second phase is dispersed as coarse aggregates. In addition, although the ferrite area ratio is smaller as compared with the sample of the FIG. 1, only a few ferrite are dotted surrounded by the second phase in a shape of an island, resulting in continuously existing ferrite grains.

Figure 4:
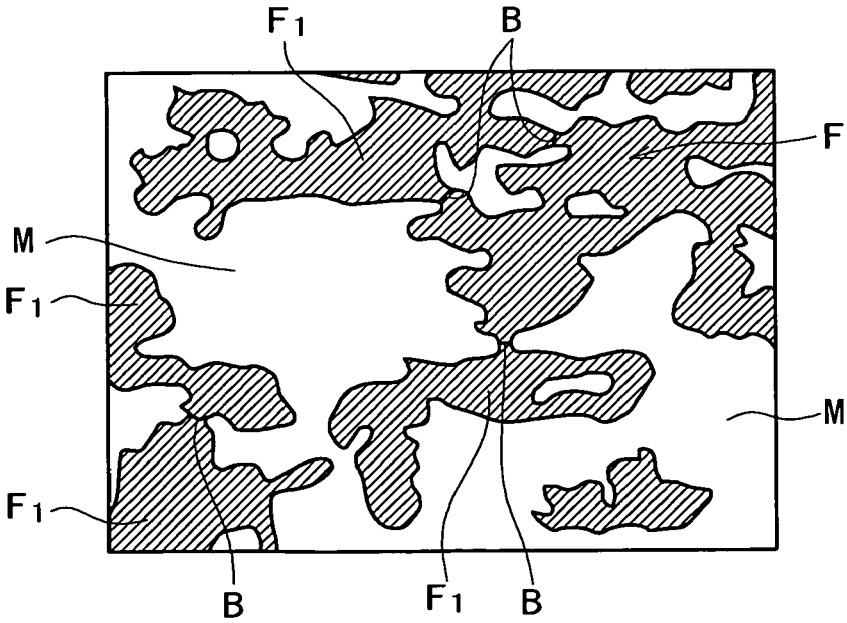
FIG. 4 is a schematical diagram conceptually showing an expanded microstructure photograph of a steel sheet with a composite structure as comparative material.

FIG. 4 is an enlarged drawing schematically showing the metallographic structure to illustrate the specificity of a metallographic structure of the conventional steel sheets with a composite structure. In FIG. 4, M shows a second phase precipitated in a shape of a network, F1 and F1 show each of ferrite grains, and F shows ferrite aggregates including ferrite grains existing continuously. As is clear when FIG. 4 is compared with FIG. 3 (material of the present invention), networks of martensite M is very coarse, and many of them exist as a big mass. Moreover, each of ferrite grains F1 and F1 divided by the martensite M is relatively coarse, and at the same time plural them are combined together (in FIG. 4, B's are combining sites) to form the ferrite aggregate F. As a result, a circle-equivalent average grain diameter of the aggregate F is not less than 3 times of a circle-equivalent average grain diameter of each of ferrite grains F1 and F1.

FIGS. 2 and 4 illustrate typical metallographic structures of steel sheets with a composite structure produced with conventional methods. Not only in this example, but in conventional steel sheets with a composite structure when aiming at coexistence of elongation and stretch flange formability, it has been confirmed that especially a steel sheet with a composite structure having a ferrite area ratio exceeding 30% gives circle-equivalent diameters of a region with a small number of ferrites combined, and of a ferrite aggregate exceeding 3 times of circle-equivalent average ferrite grain size, which gives inferior density.

In addition, as is described in detail later, it is confirmed that: inclusion of Nb, Ti, V, etc. having structure refining effect, as a steel component, enables refining of the circle-equivalent average grain diameter of ferrite grains; inclusion of Mo or Cr also enables, by the structure refining effect, the circle-equivalent average grain diameter of the ferrite grains to be controlled to not more than 10 μm; and such refining of ferrite grains can be attained by the conventional technology as described above. However, even if a condition of the average grain diameter of ferrite grains is satisfied, it will be shown clearly in the after-mentioned Example that a balance of elongation/stretch flange formability of a level desired by the present invention may not be obtained, when a circle-equivalent average diameter of a ferrite aggregate exceeds 3 times of a circle-equivalent average ferrite grain size.

Therefore, the present invention has indispensable requirements that, based on a premise of satisfying requirements for component compositions described later, the metallographic structure has a composite structure of a ferrite+a second phase; the second phase is combined approximately in a shape of a network with an area ratio of not less than 30% and not more than 70%; a circle-equivalent average ferrite grain size is not more than 10 μm; and a circle-equivalent diameter of a ferrite aggregate continuously existing in an area surrounded by the second phase is not more than 3 times of the circle-equivalent average ferrite grain size.

A more preferable area ratio of the second phase is not less than 40% and not more than 60%. A more preferable circle-equivalent average ferrite grain size is not more than 7 μm, and although a minimum value is not especially limited, approximately 2 μm is considered to be a minimum in consideration of actual operation. Besides, a preferable circle-equivalent diameter of a ferrite aggregate is not more than 2 times of a circle-equivalent average ferrite grain size.

In determination of the metallographic structure, a metallographic structure is exposed by processing a surface of a section in a rolling direction of each sample steel sheet with Nital liquid. Then five places of approximately 80 μm×60 μm of area of sheet thickness of ¼ were observed by SEM images with magnification of 1000 times to determine an area ratio of a ferrite and a second phase, a circle-equivalent average ferrite grain size, and a circle-equivalent diameter of ferrite aggregate by image analysis.

Hereinafter, description will be given for chemical compositions of a steel sheet of the present invention. Hereafter, all units of the chemical composition are based on mass %.

C: 0.05 to 0.13%

C is an essential element to improve strength. C increases hardenability and forms hard martensite etc. by low-temperature transformation, and is indispensable for securing high-strength essential as a structural material etc. A hardness of the second phase depends on an amount of C in a composite structure having a ferrite as a parent phase, and composed of this parent phase and a second phase (mainly tempered martensite or martensite) as in the present invention. Therefore, in order to harden the second phase and to increase stretch flange formability while securing strength, a content of C is very important and not less then 0.05% of inclusion is indispensable. Less than 0.05% of content gives unsatisfactory hardness to the second phase, and it not only provides insufficient strength as whole but it provides inadequate stretch flange formability. More preferable C content is not less than 0.08%. However, since C content exceeding 0.13% excessively hardens the second phase and reduces elongation and stretch flange formability, it should be controlled not more than the quantity. More preferable C content is not more than 0.10%.

Si: 0.5 to 2.5%

Si is useful also as a solid-solution-strengthening element, it has a function for increasing strength, especially without degrading stretch flange formability, and in addition it is an element useful for expanding transformation-temperature range and enabling easy control of metallographic structure. In order to effectively exhibit such a function, not less than 0.5% of content is necessary, and preferably not less than 1.0% of content. However, since excessive Si content has an adverse effect on stretch flange formability and elongation, and degrades chemical conversion treatability etc., and therefore desirably the content is controlled not more than 2.5%, and more preferably not more than 2.0%.

Mn: 0.5 to 3.5%.

Mn is an element for promoting hardening like the C. In order to form sufficient amount of hard second phase through low-temperature transformation by hardening after annealing, not less than 0.5% of content is necessary, preferably not less than 1.0%, and more preferably not less than 1.5%. However, since an excessive amount of Mn makes area ratios of the second phase increase rapidly and it also markedly reduces elongation and stretch flange formability, an amount should be controlled not more than 3.5%. More preferable Mn content is not more than 3.0%, and more preferably not more than 2.5%.

Mo: 0.05 to 0.6% and/or Cr: 0.05 to 1.0%

These Mo and Cr are important additional elements in the present invention. Although theoretical reasons are not yet clarified enough, experimental results show functions of increasing hardness of a ferrite parent phase and of concurrently controlling hardness of the second phase, and while the elements exhibit very important function in order to reduce a ratio of hardness and a hardness difference between the ferrite phase and the second phase, and to increase elongation and stretch flange formability, they contribute also to improvement in hardness as a whole steel. In order to effectively exhibit such a function, inclusion of not less than 0.05% of Cr and not less than 0.05% of Mo is indispensable. Inclusion of not less than 0.10% of Mo and not less than 0.20% of Cr is preferred. These may be included independently, and two sorts may be added in combination. However, since excessive inclusion of those elements reduces homogeneity of structure, deteriorates stretch flange formability, preferably Mo is controlled not more than 0.6%, and Cr is controlled not more than 1.0%. In case of compound addition of Mo and Cr, in order to avoid occurrence of the fault a total amount is preferably controlled not more than 1.2%. Besides, it is confirmed that such an improvement effect of elongation and stretch flange formability by Mo and Cr is markedly promoted conjointly with refining, uniformity, and denseness of the composite metal structure.

In addition to the components, a steel sheet of the present invention may include following components.

At least One Kind Selected from a Group Composed of Ti: 0.005 to 0.05%, Nb: 0.005 to 0.05%, and V: 0.005 to 0.2%

These Ti, Nb, and V have precipitation-accelerating and structure-refining effect, and especially refine a ferrite grain size, and contribute to improvement in elongation. In addition, they have function of improving strength and stretch flange formability by structure refining as whole. The function is effectively exhibited by inclusion of not less than the lower limit of each component, but since each of contents exceeding each of maximum values reduces elongation and adversely affects elongation/stretch flange formability balance, careful attention must be paid for the amounts thereof. Principal elements in a steel sheet with a composite structure concerning the present invention are described above, and remainder is substantially Fe, but following elements may be included in a range that does not impair operational advantage distinctive to the present invention mentioned above.

Al: not more than 0.10%

Al functions effectively as a deoxidizer, and it is an element effective also for reducing a function that prevents refining of ferrite grain caused by dissolved N by fixing N, as AlN, possibly mixed into an ingot steel. However, since an excessive quantity makes a ferrite parent phase coarser and has adverse influence on stretch flange formability, it should be controlled not more than 0.10%.

S: not more than 0.005%

S is a harmful element generally having adverse influence on workability and strength of steel. Since it has significant adverse influence in stretch flange formability also in the present invention, it should be controlled not more than 0.005%.

N: not more than 0.01%

It is thought that N is effective because N reacts with the Ti, Nb, V, Al, etc., to form nitride, and contributes to refining of a ferrite phase. However, when much amount of N content increases an amount of dissolved N, since it will have significant adverse influence in elongation or stretch flange formability it should be controlled not more than 0.01%.

P: not more than 0.03%

P is considered to be a harmful element generally degrading weldability of steel, and it is desirable to be controlled not more than 0.03% also in the present invention.

The Al, S, N, P, etc. are elements mixed unavoidably in ingot stages, and are preferably decreased as much as possible, respectively, based on the reasons mentioned above. Besides these elements, suitable amount of addition of, for example, Cu, Ni, Co, W, Zr, B, Ca, REM, etc. enables effective use of function of these elements in a range not giving adverse influence on operational advantage aimed by the present invention.

As mentioned above, a cold-rolled steel sheet of the present invention has a high strength not less than 780 MPa and exhibits a balance of elongation/stretch flange formability exceeding conventional materials by satisfying a specific metallographic structure and a specific chemical composition. Those detailed values show not less than 14% of an elongation (El), and not less than 50% of a stretch flange formability (λ), and both of them are physical properties exceeding those of conventional materials. Incidentally, in conventional technology mentioned above, as will be clarified also in the after-mentioned Examples, materials showing not less than 14% of an elongation (El) show a stretch flange formability (λ) less than 50%, and materials showing not less than 50% of a stretch flange formability (λ) show less than 14% of an elongation (El) by common examining methods. Thus, a steel sheet with a composite structure being able to satisfy both of the elongation and stretch flange formability cannot be obtained.

In a steel sheet with a composite structure of the present invention having the distinctive balance of elongation/stretch flange formability, a characteristic thereof appears directly also in a ratio (HvII/Hvα) between an average hardness (HvII) of the second phase and an average hardness (Hvα) of a ferrite parent phase, and the steel sheet is characterized in that the ratio shows a low value of not more than 3.0, and preferably not more than 2.0. That is, although it is confirmed, also in conventional steel sheets with a composite structure, that a small ratio (HvII/Hvα) mentioned above is preferable in order to increase a balance of elongation/stretch flange formability, the ratio exceeds 3.0 also in examples having small ratios, and examples having the ratio not more than 3.0 are not known. Therefore, a steel sheet with a composite structure of the present invention also may be recognized to have characteristic physical property showing a low ratio (HvII/Hvα) not more than 3.0.

As mentioned above, a steel sheet with a composite structure of the present invention exhibits high-strength, and superior elongation/stretch flange formability balance by possessing a proper component composition and a characteristic metallographic structure, and methods for manufacturing the steel sheet are not especially limited. Preferable manufacturing conditions for obtaining the proper steel sheet with a composite structure will, hereinafter, be illustrated, on condition that a steel satisfying requirement for the chemical composition is used as a material.

That is, a steel satisfying the requirements for the component is smelted, a slab is obtained by continuous casting or ingot making, and, subsequently it is hot-rolled. In hot-rolling, after a finish temperature of finish rolling is set not less than Ar3 point, and appropriately cooled, a rolled steel is coiled in a temperature range of 450 to 700° C. After hot-rolling, the rolled sheet is pickled and then cold-rolled. A cold-rolling rate is preferably set not less then about 30%.

Recrystallizing annealing and cooling performed after cold-working, and furthermore a processing condition of subsequent overaging are important processes in order to obtain a steel sheet with a composite structure by formation of a second phase structure as a low-temperature transformation product. After recrystallizing annealing at a temperature of not less than Ac1 point, a sheet is cooled at a rate of 10 to 30° C./s, and then it is hardened by quenching at a rate of not less than 100° C./s from a temperature range of 700° C. to 600° C., and furthermore, is overaged in a temperature range of 180° C. to 450° C.

In order to avoid remaining of processing structure of the hot rolled steel sheet, a finishing temperature of hot-rolling is set at not less than Ar3 point, and thus a composite structure comprising a low-temperature transformation product and a ferrite may be obtained by coiling in a temperature range of 450 to 650° C. The low-temperature transformation product means a martensite and a bainite. In the present invention, the second phase preferably has a martensite as a main constituent, and more preferably not less than approximately 70% of the second phase is of a martensite. In order for the second phase to have a martensite as a main constituent, a cooling rate following the annealing process is set high as mentioned later.

A cold-rolling rate is set not less than 30% in order to promote recrystallization, an austenite phase is formed in the annealing process by performing the recrystallizing annealing (a soaking temperature) at a temperature of not less than Ac1 point, and then a partial ratio is set as 30 to 70% by subsequent cooling.

The austenite phase is transformed into a low-temperature transformation product comprising the martensite (or tempered martensite and bainite) by following cooling. In order to prevent precipitation of a perlite or increase of a ferrite phase, the cooling rate is set at least not less than 10° C./s, and preferably not less than 30° C./s. An ultra high-speed cooling as water quenching etc. is also preferred.

After quenching, aging (annealing) treatment is performed for hardness adjustment of the low-temperature transformation product. An excessively low aging temperature fails to diffuse carbon, and excessively high aging temperature conversely causes too much softening, resulting in insufficient strength. Therefore, an aging treatment is desirably carried out in a range of 180 to 400 degrees C. for about 1 to 10 minutes.

For example, adoption of the above manufacturing conditions may satisfy requirements for a metallographic structure mentioned above in combination with a steel component mentioned above, and simultaneously may provide a steel sheet with a composite structure having a high-strength, and a well-balanced elongation/stretch flange formability in a high level. In order to realize a structure characterized in the present invention, a cooling rate after hot-rolling finishing and soaking temperature conditions of an annealing process in manufacturing conditions are important requirements.

EXAMPLE

Although the present invention will, hereinafter, be described more in detail with reference to Examples, the present invention is not at all limited by the following Examples. Of course, the present invention may suitably be carried out in a range that may suit the above and the after-mentioned spirit, and each of the modification is included by a technical scope of the present invention.

Test sample steels (unit in Table is mass %) having component compositions indicated in following Table 1 were smelted, slabs were obtained with a conventional method, and then the slabs obtained were hot-rolled on conditions shown in Table 2 to obtain 2-mm-thick hot-rolled steel sheets. After pickling, the steel sheets were cold-rolled into a thickness of 1.2 mm, and they were annealed on conditions shown in the Table.

Sections in 5 areas (about 80 μm×60 μm) of sheet thickness of ¼ in a rolling direction of obtained steel sheet were observed as images with 1000 times of magnification by SEM. Area ratios of a ferrite and the second phase, circle-equivalent average grain diameters of ferrite and circle-equivalent diameters of ferrite aggregate were obtained using image analysis. Here, regions continued out of a view of ferrite aggregates were excluded from analysis. Ferrite grains and the second phases having average grain diameters were measured for Vickers hardness according to JIS Z 2244.

Tension test was carried out according to JIS Z 2241, and JIS No. 5 test pieces of the steel sheet were measured for strength (TS) and total elongation (El), and 100 mm square steel sheets were measured for hole expanding ratios (λ) according to Japan Iron and Steel Federation specification JFST1001. Table 3 shows results. Each the second phase structure of sample steel sheets obtained in this experiment was substantially only of martensite, and others were of ferrite as a main phase.

TABLE 1

(mass %)

| Kind of steel | C | Si | Mn | P | S | Al | Cr | Mo | Additional elements |
|---|---|---|---|---|---|---|---|---|---|
| 1 | 0.125 | 1.44 | 1.50 | 0.011 | 0.0010 | 0.05 | 0.48 | 0.13 | |
| 2 | 0.064 | 1.12 | 2.03 | 0.007 | 0.0015 | 0.03 | 0.46 | 0.18 | |
| 3 | 0.091 | 0.78 | 1.64 | 0.012 | 0.0018 | 0.05 | 0.32 | 0.23 | |
| 4 | 0.115 | 1.68 | 1.76 | 0.010 | 0.0015 | 0.04 | 0.26 | 0.28 | |
| 5 | 0.098 | 1.25 | 1.07 | 0.006 | 0.0009 | 0.03 | 0.43 | 0.16 | |
| 6 | 0.071 | 1.56 | 2.40 | 0.007 | 0.0017 | 0.05 | 0.78 | 0.21 | |
| 7 | 0.111 | 0.84 | 1.09 | 0.011 | 0.0020 | 0.05 | 0.26 | 0.03 | |
| 8 | 0.101 | 0.94 | 1.30 | 0.016 | 0.0011 | 0.04 | 0.87 | 0.02 | |
| 9 | 0.087 | 1.33 | 1.30 | 0.018 | 0.0021 | 0.04 | 0.02 | 0.12 | |
| 10 | 0.111 | 1.07 | 2.34 | 0.008 | 0.0006 | 0.04 | 0.04 | 0.56 | |
| 11 | 0.098 | 1.47 | 1.41 | 0.008 | 0.0008 | 0.05 | 0.72 | 0.44 | |
| 12 | 0.094 | 1.03 | 2.22 | 0.014 | 0.0020 | 0.03 | 0.68 | 0.34 | Nb: 0.021 |
| 13 | 0.094 | 0.81 | 1.32 | 0.011 | 0.0021 | 0.03 | 0.41 | 0.12 | Ti: 0.043 |
| 14 | 0.073 | 1.48 | 1.56 | 0.010 | 0.0017 | 0.04 | 0.63 | 0.29 | V: 0.12 |
| 15 | 0.043 | 1.17 | 1.01 | 0.009 | 0.0022 | 0.05 | 0.55 | 0.18 | |
| 16 | 0.145 | 1.36 | 2.43 | 0.010 | 0.0005 | 0.03 | 0.63 | 0.26 | |
| 17 | 0.097 | 0.41 | 1.40 | 0.020 | 0.0012 | 0.04 | 0.79 | 0.20 | |
| 18 | 0.077 | 2.62 | 1.85 | 0.016 | 0.0015 | 0.04 | 0.44 | 0.09 | |
| 19 | 0.088 | 1.31 | 0.32 | 0.018 | 0.0016 | 0.03 | 0.38 | 0.19 | |
| 20 | 0.081 | 1.00 | 3.65 | 0.013 | 0.0021 | 0.04 | 0.45 | 0.17 | |
| 21 | 0.107 | 0.98 | 1.75 | 0.012 | 0.0024 | 0.05 | 0.03 | 0.02 | |
| 22 | 0.112 | 1.13 | 2.29 | 0.018 | 0.0013 | 0.05 | 1.13 | 0.18 | |
| 23 | 0.072 | 1.40 | 1.07 | 0.010 | 0.0008 | 0.03 | 0.10 | 0.87 | |

TABLE 2

| Referential numeral | Kind of steel | Hot-rolling conditions: Finishing temperature (° C.) | Primary cooling rate (° C./s) | Cooling termination temperature (° C.) | Air cooling period (s) | Secondary cooling rate (° C./s) | Coiling up temperature (° C.) | Annealing condition: Soaking temperature (° C.) | Forced cooling starting temperature (° C.) | Overaging temperature (° C.) |
|---|---|---|---|---|---|---|---|---|---|---|
| 1 | 1 | 900 | 35 | 690 | 8 | 30 | 480 | 900 | 660 | 270 |
| 2 | 2 | 890 | 60 | 690 | 8 | 35 | 520 | 880 | 670 | 230 |
| 3 | 3 | 880 | 55 | 670 | 11 | 25 | 520 | 830 | 680 | 240 |
| 4 | 4 | 900 | 50 | 660 | 12 | 35 | 490 | 860 | 650 | 280 |
| 5 | 5 | 880 | 40 | 670 | 7 | 35 | 510 | 860 | 650 | 270 |
| 6 | 6 | 890 | 50 | 680 | 6 | 40 | 530 | 860 | 640 | 240 |
| 7 | 7 | 880 | 45 | 660 | 13 | 30 | 560 | 890 | 660 | 270 |
| 8 | 8 | 890 | 45 | 660 | 6 | 40 | 550 | 890 | 650 | 290 |
| 9 | 9 | 910 | 55 | 680 | 10 | 25 | 500 | 850 | 650 | 260 |
| 10 | 10 | 870 | 50 | 690 | 12 | 20 | 520 | 830 | 640 | 250 |
| 11 | 11 | 880 | 40 | 690 | 10 | 25 | 500 | 850 | 640 | 280 |
| 12 | 12 | 890 | 30 | 680 | 7 | 35 | 530 | 880 | 660 | 220 |
| 13 | 13 | 860 | 50 | 660 | 8 | 20 | 530 | 900 | 680 | 290 |
| 14 | 14 | 890 | 30 | 690 | 13 | 40 | 540 | 840 | 680 | 270 |
| 15 | 15 | 900 | 50 | 650 | 10 | 45 | 520 | 890 | 630 | 320 |
| 16 | 16 | 890 | 35 | 680 | 7 | 30 | 550 | 880 | 700 | 230 |
| 17 | 17 | 880 | 60 | 650 | 7 | 45 | 500 | 890 | 680 | 300 |
| 18 | 18 | 870 | 60 | 660 | 10 | 35 | 490 | 880 | 670 | 290 |
| 19 | 19 | 880 | 30 | 660 | 11 | 45 | 490 | 850 | 620 | 270 |
| 20 | 20 | 890 | 55 | 680 | 13 | 30 | 550 | 850 | 680 | 280 |
| 21 | 21 | 900 | 45 | 670 | 12 | 10 | 630 | 840 | 650 | 310 |
| 22 | 22 | 890 | 35 | 680 | 8 | 35 | 540 | 880 | 680 | 270 |
| 23 | 23 | 900 | 40 | 870 | 5 | 50 | 530 | 840 | 620 | 290 |

TABLE 3

| Referential numeral | Kind of steel | Microstructure: VII (%) | dα (μm) | Circle-equivalent diameter of α aggregate (μm) | Hardness: HvII (Hv) | Hvα (Hv) | HvII/Hvα | Mechanical property: YS (MPa) | TS (MPa) | El (%) | λ (%) |
|---|---|---|---|---|---|---|---|---|---|---|---|
| 1 | 1 | 47 | 3.0 | 4.7 | 413 | 194 | 2.1 | 743 | 992 | 16.3 | 64 |
| 2 | 2 | 61 | 4.2 | 5.9 | 364 | 199 | 1.8 | 842 | 1027 | 15.3 | 82 |
| 3 | 3 | 49 | 6.4 | 9.3 | 382 | 184 | 2.1 | 784 | 985 | 15.7 | 65 |
| 4 | 4 | 51 | 7.8 | 10.9 | 380 | 185 | 2.1 | 760 | 995 | 16.4 | 65 |
| 5 | 5 | 33 | 2.0 | 3.5 | 407 | 171 | 2.4 | 566 | 791 | 20.4 | 79 |
| 6 | 6 | 58 | 2.9 | 4.3 | 433 | 198 | 2.2 | 925 | 1112 | 14.3 | 85 |
| 7 | 7 | 33 | 7.6 | 9.8 | 422 | 179 | 2.4 | 584 | 804 | 19.4 | 63 |
| 8 | 8 | 52 | 2.6 | 4.9 | 396 | 183 | 2.2 | 765 | 1006 | 15.7 | 62 |
| 9 | 9 | 34 | 6.7 | 9.4 | 405 | 178 | 2.3 | 574 | 797 | 20.1 | 87 |
| 10 | 10 | 64 | 2.7 | 3.7 | 369 | 208 | 1.8 | 926 | 1093 | 14.1 | 71 |
| 11 | 11 | 54 | 5.4 | 8.4 | 374 | 210 | 1.8 | 779 | 1024 | 16.0 | 56 |
| 12 | 12 | 63 | 4.1 | 6.0 | 436 | 192 | 2.3 | 966 | 1143 | 14.3 | 78 |
| 13 | 13 | 47 | 2.4 | 3.6 | 402 | 183 | 2.2 | 773 | 1018 | 15.3 | 56 |
| 14 | 14 | 53 | 5.2 | 8.9 | 356 | 195 | 1.8 | 753 | 984 | 16.6 | 63 |
| 15 | 15 | 22 | 10.4 | 53.4 | 389 | 166 | 2.3 | 547 | 762 | 21.1 | 23 |
| 16 | 16 | 70 | 11.6 | 42.5 | 491 | 182 | 2.7 | 1079 | 1276 | 9.6 | 38 |
| 17 | 17 | 53 | 3.6 | 11.3 | 438 | 132 | 3.3 | 815 | 1015 | 15.1 | 34 |
| 18 | 18 | 33 | 8.2 | 35.1 | 366 | 221 | 1.7 | 777 | 1076 | 16.0 | 32 |
| 19 | 19 | 24 | 6.6 | 17.3 | 449 | 138 | 3.3 | 426 | 669 | 24.5 | 39 |
| 20 | 20 | 72 | 4.7 | 8.9 | 390 | 229 | 1.7 | 1199 | 1215 | 10.4 | 62 |
| 21 | 21 | 39 | 12.7 | 44.5 | 419 | 176 | 2.4 | 664 | 854 | 18.1 | 32 |
| 22 | 22 | 68 | 5.8 | 22.6 | 386 | 218 | 1.8 | 1122 | 1297 | 9.2 | 36 |
| 23 | 23 | 53 | 2.9 | 12.1 | 372 | 229 | 1.6 | 811 | 1105 | 14.8 | 27 |

In Tables 1 to 3, referential numerals 1 to 14 represent Examples satisfying all requirements for regulation of the present invention. They have proper chemical compositions, and hot-rolled conditions, and subsequent cooling conditions and annealing conditions are suitable to provide preferable metallographic structures, and therefore they can show tensile strengths exceeding 780 MPa in a high level, and they also show high values of elongations and stretch flange formability.

On the other hand, since referential numerals 15 to 23 lack either of requirements of the present invention, they have problems, as follows, in some performance aimed by the present invention.

Since referential numeral 15 has an insufficient C content, it has a small partial ratio of a second phase. And ferrite grains thereof are excessively combined together and therefore a low strength and inferior hole expanding property are exhibited. Although a referential numeral 16 has many C contents and it has comparatively few ferrite phases, many of ferrite grains are combined together. Since a referential numeral 17 has a small Si content and it has a large hardness ratio of a ferrite and a second phase, poor hole expanding property is exhibited. A referential numeral 18 has an excessive Si content, and combination of ferrite grains advances and inferior hole expanding property is exhibited.

A referential numeral 19 has an inadequate Mn content and an inadequate second phase partial ratio, exhibits large hardness ratio of ferrite and the second phase, and furthermore exhibits unsatisfactory strength and hole expanding property. A referential numeral 20 has an excessive Mn content, and second phase partial ratio, and exhibits poor ductility. A referential numeral 21 has inadequate Cr and Mo content, and therefore has coarse ferrite grains, and furthermore since it has many ferrite grains combined together, it exhibits inferior hole expanding property. Referential numerals 22 and 23 have excessive Cr and Mo content respectively, and simultaneously since they have many ferrite grains combined together, they show inferior hole expanding property.

FIG. 1 is a SEM photograph showing a microstructure of a steel sheet with a composite structure (referential numeral 2) in Example of the present invention, wherein the structure consists of a second phase (martensite) combined together in a shape of a thin network, and a ferrite phase divided with the network and finely dispersed (main phase). A crystal grain diameter of each ferrite is fine, and simultaneously there is a little average number of ferrite grains in ferrite aggregates divided with network composed of martensite, and therefore the ferrites are finely dispersed as a whole. On the other hand, FIG. 2 is a SEM photograph showing a microstructure of a referential numeral 16 as comparison material, wherein a second phase (martensite) coarsely solidified as compared with Example material of FIG. 1 is roughly dispersed, and a state may be confirmed where large ferrite aggregates having many ferrite grains combined together therebetween are roughly dispersed.

That is, comparison of FIG. 1 and FIG. 2 clarifies that the Example material of FIG. 1 has a very dense and wholly uniform microstructure, but on the other hand the comparative material of FIG. 2 has a coarse and wholly uneven microstructure.

The foregoing invention has been described in terms of preferred embodiments. However, those skilled, in the art will recognize that many variations of such embodiments exist. Such variations are intended to be within the scope of the present invention and the appended claims.

The invention claimed is:

1. A high-strength cold-rolled steel sheet, excellent in elongation and stretch flange formability, which comprises a steel including C: 0.05 to 0.13 mass %, Si: 0.5 to 2.5 mass %, Mn: 0.5 to 3.5 mass %, and at least one of Mo: 0.05 to 0.6 mass % and Cr: 0.05 to 1.0 mass %, wherein the steel is of composite structure of a ferrite + a second phase, the second phase having an area ratio of 30 to 70% and being combined approximately in a shape of a network, a circle-equivalent average ferrite grain size being not more than 10 μm, and a circle-equivalent diameter of ferrite grain aggregate that exists continuously in an area surrounded by the second phase being not more than 3 times of the average ferrite grain size.

2. The high-strength cold-rolled steel sheet according to claim 1, further including at least one element selected from a group composed of Ti: 0.005 to 0.05 mass %, Nb: 0.005 to 0.05 mass %, and V: 0.005 to 0.2 mass %.

3. The high-strength cold-rolled steel sheet according to claim 1, wherein the second phase is mainly of tempered martensite or of martensite.

4. The high-strength cold-rolled steel sheet according to claim 1, wherein a ratio (HvII/Hvα) of an average hardness (HvII) of the second phase to an average hardness (Hvα) of the ferrite phase is not more than 3.0.

5. The high-strength cold-rolled steel sheet according to claim 1, wherein an elongation (El) is not less than 14%, and a stretch flange formability (λ) is not less than 50%.

6. The high-strength cold-rolled steel sheet according to claim 1, wherein a tensile strength (Ts) is not less than 780 MPa.

* * * * *

UNITED STATES PATENT AND TRADEMARK OFFICE

CERTIFICATE OF CORRECTION

PATENT NO. : 7,371,294 B2
APPLICATION NO. : 11/045309
DATED : May 13, 2008
INVENTOR(S) : Miura et al.

It is certified that error appears in the above-identified patent and that said Letters Patent is hereby corrected as shown below:

On the title page, Item (73), the Assignee information is incorrect. Item (73) should read as follows:

-- (73) Assignee: Kabushiki Kaisha Kobe Seiko Sho (Kobe Steel, Ltd.), Kobe-shi (JP) --

Signed and Sealed this

Fifth Day of August, 2008

JON W. DUDAS
*Director of the United States Patent and Trademark Office*